United States Patent [19]

Takenobu

[11] Patent Number: 4,506,191

[45] Date of Patent: Mar. 19, 1985

[54] LIGHT SOURCE CATHODE RAY TUBE

[75] Inventor: Shinya Takenobu, Kyoto, Japan

[73] Assignee: Mitsubishi Denki Kabushiki Kaisha, Tokyo, Japan

[21] Appl. No.: 306,804

[22] Filed: Sep. 29, 1981

[30] Foreign Application Priority Data

Sep. 29, 1980 [JP] Japan ..... 55-137359

[51] Int. Cl.[3] ..... H01J 29/46; H01J 29/56

[52] U.S. Cl. ..... 315/14; 313/495; 358/237

[58] Field of Search ..... 315/14, 15, 382; 313/447, 448, 450, 495, 364; 358/60, 64, 237

[56] References Cited

U.S. PATENT DOCUMENTS 2,971,118 2/1961 Burdick ..... 313/449

4,336,480 6/1982 Kobayashi ..... 313/495

*Primary Examiner*—Theodore M. Blum

*Attorney, Agent, or Firm*—Sughrue, Mion, Zinn, Macpeak, and Seas

[57] ABSTRACT

A cathode ray tube light ray source uses only a single current control electrode between the cathode and anode, and the aperture in the electrode is between 1 mm and 3 mm in diameter. The distance from cathode to current control electrode is also between 1 mm and 3 mm. The anode is preferably a graphite film deposited on the interior of the envelope and extending over the entire distance from the current control electrode to the fluorescent screen.

13 Claims, 11 Drawing Figures

LIGHT SOURCE CATHODE RAY TUBE

BACKGROUND OF THE INVENTION

This invention relates to cathode ray tubes employed as light sources.

Heretofore, various light source lamps, small monochromatic cathode ray tubes or the like have been employed as light source tubes for display illumination. The luminance of the light source lamps is insufficient, and the service lives thereof are relatively short. Thus, the maintenance of the light source lamps is rather troublesome. In small monochromatic cathode ray tubes, an electron beam emitted from a sealed electron gun is deflected to cause the flourescent screen to emit light. Therefore, the small monochromatic cathode ray tubes are disadvantageous in that the provision of an electron beam deflecting circuit is required. This makes the drive circuit intricate, and it is considerably difficult to simultaneously drive a plurality of small monochromatic cathode ray tubes.

FIG. 1 is a schematic sectional view of a conventional three-electrode type electron gun showing the positional relationship between the electron gun and the fluorescent screen 5 of the cathode ray tube which contains the electron gun. The electron gun includes a cathode 4, a first grid 1, a second grid 2 and a third grid 3.

An electron beam 6 emitted from the cathode 4 having an electron emitting material is controlled by a voltage $E_{C1}$ applied to the first grid 1. The electron beam 6 thus controlled is accelerated by a voltage $E_{C2}$ applied to the second grid 2 and is further accelerated by a voltage applied to the third grid 3, so that the beam strikes a fluorescent screen 5 which consequently emits light. The fluorescent screen 5 is so connected (not illustrated) that the potential of the screen 5 is equal to the potential $E_{C3}$ of the third grid 3. A hole 0.5 to 1 mm in diameter is cut in the portion of the first grid 1, which confronts the cathode 4. Similarly, a hole 0.5 to 1 mm in diameter is cut in the portion of the second grid 2 which confronts the hole of the first grid 1.

The confronting openings of the second and third grids 2 and 3 constitute cylindrical electrodes which form an electron lens. With this arrangement, the current $I_K$ of the electron beam 6 will vary as the voltage $E_{C1}$ of the first grid 1 is varied, and the diversion of the electron beam 6 is suppressed by the cylindrical electron lens formed by the second and third grids 2 and 3 so that the electron beam 6 advances to the fluorescent screen as shown, as a result of which a circular optical spot appears on the fluorescent screen 5. The diameter of optical spot is represented by D in FIG. 1.

FIG. 2 is a graphical representation indicating the relationships between the currents $I_K$ of electron beams emitted from the electron gun shown in FIG. 1 and the diameters D of optical spots on the fluorescent screens of the cathode ray tube.

In a device as shown in FIG. 1, the optical spot diameter D will change with the distance between the fluorescent screen 5 and the second grid 2. Therefore, the distance therebetween is fixed. In addition, the voltage $E_{C2}$ is also set to a certain value. Under this condition, let us consider the optical spot diameter D in the case where the electron beam current $I_K$ is $I_{KO}$ ($I_K=I_{KO}$). When the fluorescent screen voltage $E_{C3}$ is $E_a$, $D=D_a$; when $E_{C3}=E_b$, $D=D_b$; and when $E_{C3}=E_c$, $D=D_c$, where $E_c<E_b<E_a$. In other words, as the voltage of the fluorescent screen 5 is decreased, the optical spot diameter D is increased; and as the fluorescent screen voltage $E_{C3}$ is increased the diameter D is decreased.

The luminance of the optical spot may be increased by increasing the fluorescent screen voltage $E_{C3}$, but in such a case the optical spot diameter D is decreased. Further, if the current $I_K$ is small (for instance 0 to 50 μA), it may be impossible to obtain a sufficiently large optical spot diameter D even if the fluorescent screen voltage is decreased. The ratio ($D/I_K$) of an optical spot diameter D to an electron beam current $I_K$ is generally determined by the coating material forming the fluorescent screen and the fluorescent screen voltage, and the cathode ray tube should be used in such a manner that the density of the electron beam current is smaller than the maximum permissible current density for the fluorescent screen.

As is apparent from the above description and from FIG. 2, if the fluorescent screen voltage is decreased excessively, while decreasing the fluorescent screen voltage to obtain a required optical spot diameter D, then the luminance of the optical spot is decreased to the extent that the optical spot is no longer visible. The cathode ray tube is then useless as the light source. On the other hand, if the fluorescent screen voltage is maintained high, the optical spot diameter D may be set to a required value by increasing the distance between the fluorescent screen and the electron gun, but this method is not practical because it is necessary to excessively increase the length of the light source cathode ray tube.

SUMMARY OF THE INVENTION

Accordingly, this invention is intended to provide a cathode ray tube employed as a light source, in which the luminance is sufficient, in which it is unnecessary to provide an electron beam deflecting circuit and in which the drive circuit is simplified, whereby a number of cathode ray tubes can be readily arranged and driven simultaneously.

According to this invention, an electrode arrangement is provided which employs a minimum number of electrodes to allow an electron beam emitted from the cathode to form an optical spot having a required diameter on the fluorescent screen.

In the cathode ray tube according to this invention, the fluorescent screen is maintained at a high potential to cause an electron beam emitted from the electron gun within the tube to diverge uniformly to strike the entire area of the fluorescent screen. The electron beam deflecting circuit is thereby eliminated and the drive circuit is simplified, and the luminance is still sufficiently high for use as a light source tube.

More particularly, the cathode ray tube according to the present invention comprises a cathode for emitting electrons, a grid adjacent the cathode and having an aperture therein for passing the electrons, a fluorescent screen against which the electrons impinge, and a conductor extending a predetermined distance toward said screen from the grid. The cathode has a modulated voltage $E_K$ applied thereto which is at all times greater than the voltage $E_{C1}$ applied to the grid, the latter voltage being preferably in the vicinity of ground potential, and high voltage $E_b$ is applied to the conducter.

In the preferred embodiment, the anode electrode is a conductive material deposited on the inner surface of the envelope, the same high voltage is applied to the anode and screen, and the distance between the cathode and control electrode and diameter of the aperture are each between one and three millimeters.

BRIEF DESCRIPTION OF THE DRAWINGS

The invention will be more fully understood from the following description in conjunction with the accompanying drawings in which like parts are designated by similar reference numerals. In the drawings.

DETAILED DESCRIPTION OF THE PREFERRED EMBODIMENT

Figure 1:
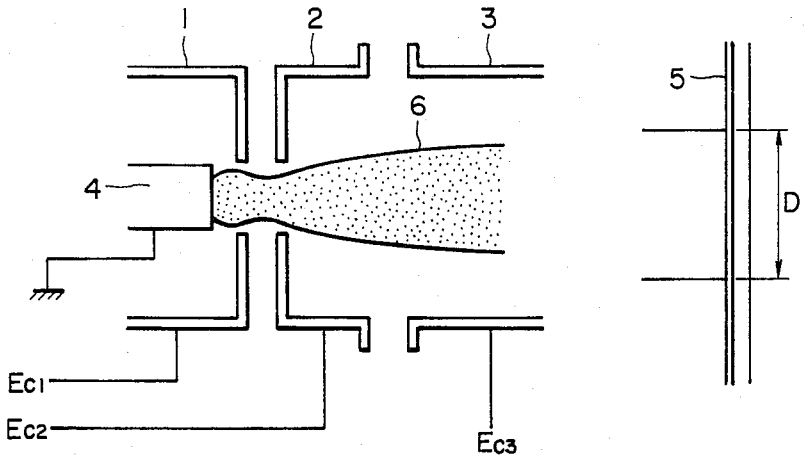
FIG. 1 PRIOR ART
FIG. 1 is an enlarged view showing the interior of an electron gun made up of three electrodes, namely, a first electrode, a second electrode and a third electrode, and a cathode.
Figure 2:
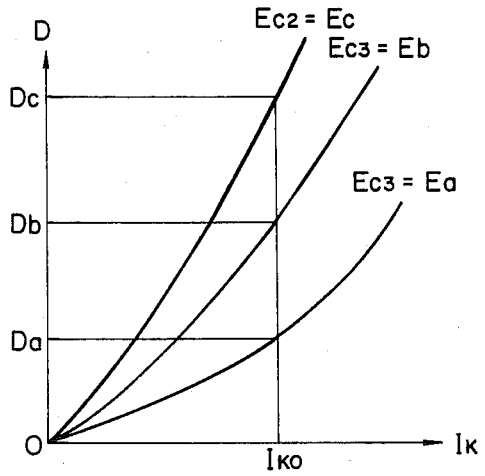
FIG. 2 is a characteristic diagram showing optical spot diameters with electron beam currents when a fluorescent screen is caused to emit light by electron beams emitted from the electron gun shown in FIG. 1.
Figure 3A:
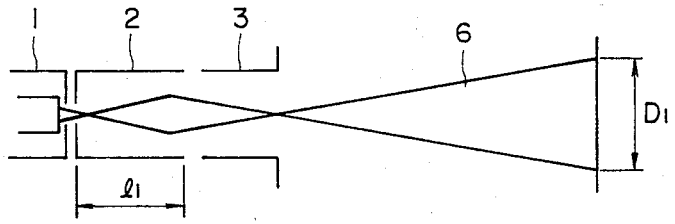
FIGS. 3*a*–3*c* are explanatory diagrams showing variations of the optical spot diameter on the fluorescent screen when the length of the second grid in a three-electrode type electron gun is changed.
Figure 3B:
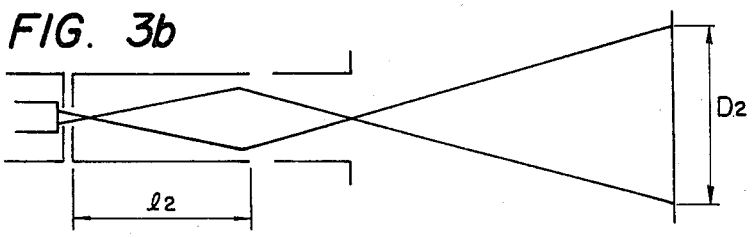
Figure 3C:
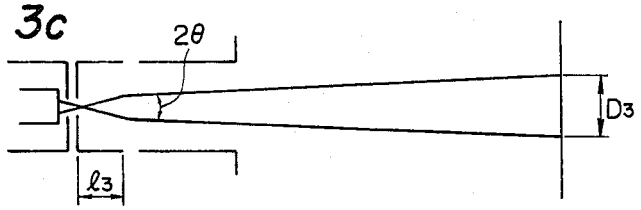

The invention will be described with reference first to FIG. 3. FIG. 3*a* shows the fact that an electron beam 6 emitted from a cathode 4 advances through a first grid 1, a second grid 2 and a third grid 3 to a fluorescent screen, where an optical spot having a diameter $D_1$ appears. The optical spot diameter $D_1$ may be increased by two methods. In one of the methods, as shown in FIG. 3*b*, the longitudinal length of the second grid 2 is increased so that the electron beam 6 is permitted to spread further before reaching the electron lens between the electrodes 2 and 3, thus increasing the focussing angle provided by the lens to form an optical spot having a diameter $D_2$. In the second method, as shown in FIG. 3*c*, the converging force of the electron lens is diminished and the longitudinal length of the second grid 2 is decreased, so the beams are not focussed a second time but instead continually diverge at a divergent angle $2\theta$. In the former method, it is possible to form an optical spot having a desired diameter on the fluorescent screen 5 by suitably selecting the length of the second grid 2. In the latter method, however, it is generally difficult to obtain an optical spot having a desired diameter even if the length of the second grid 2 is made as short as possible. This is due to the fact that the electron lens has a strong focussing force, and it is therefore necessary, but difficult, to decrease the focussing force.

Figure 4A:
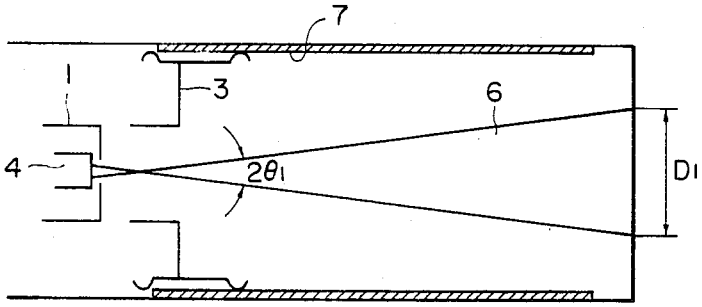
FIGS. 4*a* and 4*b* are explanatory diagrams for a description of various experiments performed to increase the optical spot diameter.
Figure 4B:
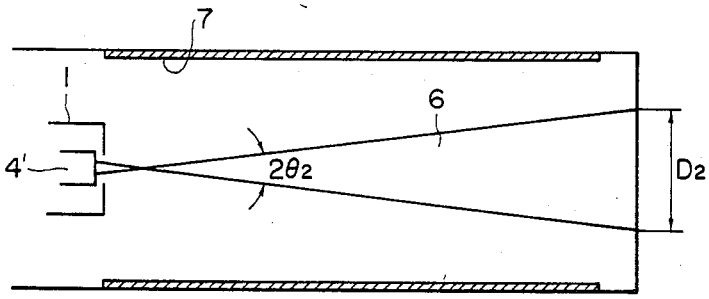
Figure 5:
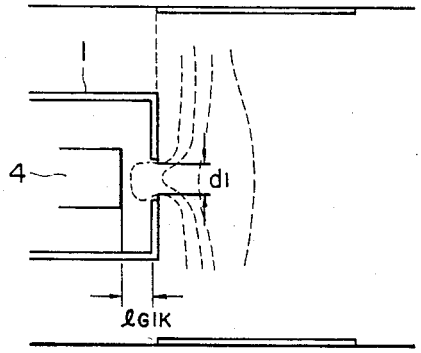
FIG. 5 is an explanatory diagram showing an electrode arrangement according to the invention.

FIG. 4 illustrates two different attempts to decrease the focusing force. In FIG. 4*a*, mainly in order to decrease the focusing force of electron lenses formed by the first grid 1, the second grid 2 and the third grid 3, the second grid 2 is removed. In this case, the divergent angle $2\theta$ is somewhat increased, but the effect is still not sufficient. In FIG. 4*b*, mainly in order to further decrease the focusing force of the electron lens formed by the first grid 1 and the third grid 3, the third grid 3 is replaced by a graphite film 7 coated on the inner wall of the cathode ray tube. In this case, it is impossible to increase the divergent angle $2\theta$ to a generally required value. In addition, the shielding effect of the second grid 2 is eliminated. Therefore, as shown in FIG. 5, the electric field expands greatly into the first grid 1 through the hole $d_1$, and the cut-off voltage $E_{KCO}$ is therefore considerably increased. However, it has been found that the divergent angle $2\theta$ can be increased to the generally required value by setting the hole diameter $d_1$ of the first grid 1 and the distance $l_{G1K}$ between the first grid 1 and the cathode 4 to suitable values, as will be explained more fully with reference to FIG. 6.

Figure 6:
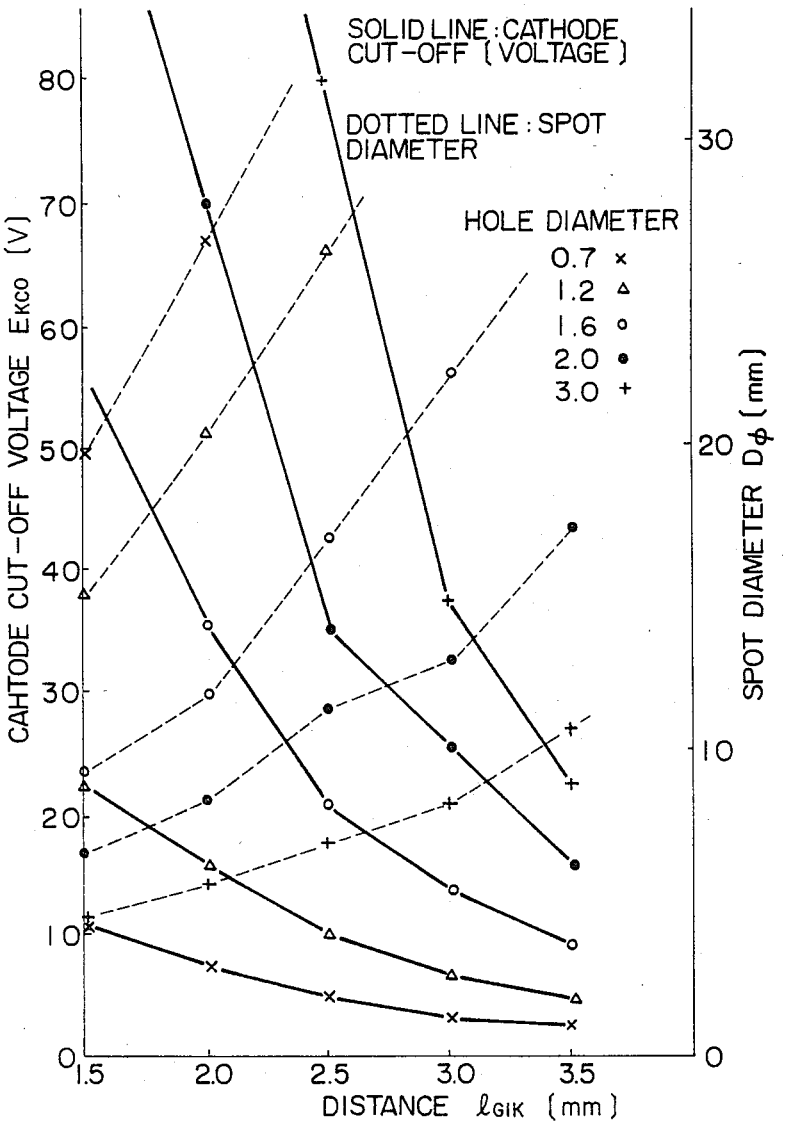
FIG. 6 is a graphical diagram showing the results of actual measurements on the electrode arrangement of the invention.

As shown in FIG. 6, it has been discovered that in the configuration of FIG. 4*b*,D will increase substantially linearly with the distance $l_{G1K}$ between the first grid and the cathode, while the cut-off voltage $E_{KCO}$ will decrease in inverse proportion to the distance $l_{G1K}$. The spot diameter D can be increased by increasing the distance $l_{G1K}$; however the cut-off voltage $E_{KCO}$ is then decreased. Therefore, when the cathode ray tube is operated under the condition the cathode voltage $E_K \geqq$ the first grid voltage $E_{C1}$, the maximum cathode current $I_{KMAS} \simeq K(E_{KCO})3/2$, (where K(constant)$\approx 3$) is decreased. Because the operation is limited in this respect, a range suitable for the distance $l_{G1K}$ is $1_{mm} < l_{G1K} < 3_{mm}$. If the first grid hole diameter $d_1$ is small, it can be seen from FIG. 6 that the distance $l_{G1K}$ for obtaining a desired value of the maximum cathode current $I_{KMAX}$ (that is, a desired value of the cut-off voltage $E_{KCO}$) becomes very small. As a result, it is impossible to obtain an acceptably large optical spot diameter D. Therefore, the diameter $d_1$ must be larger than 1 mm. Further, if the diameter $d_1$ is increased above a certain value, the cut-off voltage $E_{KCO}$, and therefore the current $I_{KMAX}$, is very low while the spot diameter is extremely large. Thus, it is impossible to obtain a spot of sufficient brightness. Thus, from the data shown in FIG. 6, a range suitable for the hole diameter $d_1$ is 1 mm$<d_1<$3 mm.

By setting to suitable values the hole diameter $d_1$ of the first grid 1, the distance $l_{G1K}$ between the first grid 1 and the cathode 4 and the distance between the first grid 1 and the fluorescent screen, an optical spot having a desired diameter can be formed on the fluorescent screen with a predetermined current.

Figure 7A:
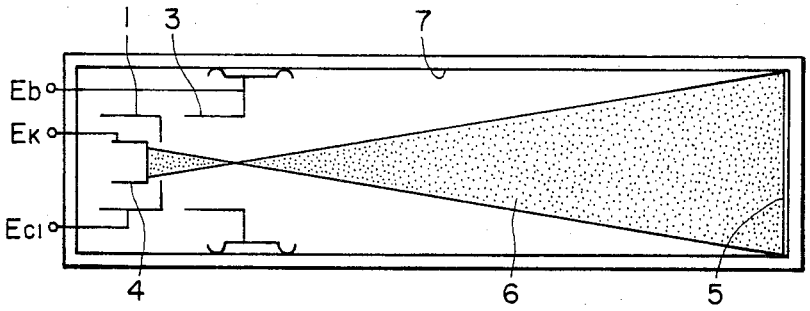
FIGS. 7*a* and 7*b* are schematic sectional views each showing a light source cathode ray tube according to the invention.
Figure 7B:
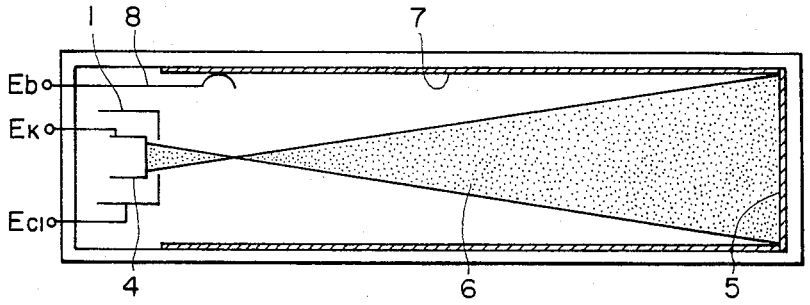

Preferred embodiments of the invention are as shown in FIGS. 7*a* and 7*b*. FIGS. 7*a* and 7*b* are schematic sectional views of a light source cathode ray tube according to the invention. Fluorescent material is coated on a portion of an envelope to form a fluorescent screen 5, which is struck by an electron beam 6. In FIG. 7*a*, a high voltage $E_b$ is applied through the third grid 3 and a contactor 8 to the fluorescent screen and to a graphite film 7 coated on the inner wall of the envelope whereas in FIG. 7*b*, it is applied through the contactor 8 to the fluorescent screen and to the graphite film 7. Either ground or a DC potential $E_{C1}$ close to the ground is applied to a first grid (or a current control electrode) 1. A modulating potential $E_K$ ($E_K \geqq E_{C1}$ at all times) is applied to a cathode 4.

As is apparent from the above-described embodiment of the invention, a small light source cathode ray tube high in luminance can be obtained by using a minimum number of electrodes. Thus, the effect of the invention should be highly appreciated.

What is claimed is:

1. A cathode ray tube light source, comprising:

an envelope having a fluorescent material on an interior surface thereof;

a cathode disposed within said envelope;

an anode disposed within said envelope;

only one current control electrode having an aperture therein and disposed between said anode and cathode, said current control electrode being separated from said cathode by a distance $l_{G1K}$ measured in a direction from said cathode to said fluorescent screen and said distance $l_{G1K}$ has a value substantially between 1 mm and 3 mm; and potential source means for applying potentials to said anode, cathode and current control electrode, the potential applied to said anode electrode being higher than the potentials applied to said cathode and current control electrode, whereby a divergent electron beam strikes said fluorescent material to cause light emission.

2. A cathode ray tube light source as defined in claim 1, wherein the potential applied to said anode is the same as that supplied to said fluorescent screen.

3. A cathode ray tube light source as defined in claim 1, wherein said aperture has a diameter substantially between 1 mm and 3 mm.

4. A cathode ray tube light source as defined in any one of claims 1, 2 or 3, wherein there is substantially no gap between said current control electrode and said anode, along a direction from said cathode to said fluorescent screen.

5. A cathode ray tube light source as defined in claim 4, wherein said anode comprises a conductive film deposited on an inner surface of said envelope.

6. A cathode ray tube as defined in claim 5, wherein said film extends all the way to said fluorescent screen.

7. A cathode ray tube as defined in claim 5, wherein said conductive film is graphite.

8. A cathode ray tube light source comprising:

an envelope having a fluorescent material on an interior surface thereof;

a cathode disposed within said envelope;

an anode disposed within said envelope;

a first current control electrode having an aperture therein and disposed between said anode and cathode, said current control electrode being separated from said cathode by a distance $l_{G1K}$ measured in a direction from said cathode to said fluorescent screen and said distance $l_{G1K}$ has a value substantially between 1 mm and 3 mm;

a second current control electrode located between said first current control electrode and said anode; and potential source means for applying potentials to said anode, cathode and first and second current control electrodes, the potential applied to said anode electrode and said second control electrode being higher than the potentials applied to said cathode and first current control electrode, whereby a divergent electron beam strikes said fluorescent material to cause light emission.

9. A cathode ray tube light source as defined in claim 8, wherein the potential applied to said anode is the same as that supplied to said fluorescent screen.

10. A cathode ray tube light source as defined in claim 1, wherein said aperture has a diameter substantially between 1 mm and 3 mm.

11. A cathode ray tube light source as defined in claim 10, wherein said anode comprises a conductive film deposited on an inner surface of said envelope.

12. A cathode ray tube as defined in claim 11, wherein said film extends all the way to said fluorescent screen.

13. A cathode ray tube as defined in claim 12, wherein said conductive film is graphite.

* * * * *